US007164396B2

(12) United States Patent
Park et al.

(10) Patent No.: US 7,164,396 B2
(45) Date of Patent: Jan. 16, 2007

(54) METHOD AND APPARATUS OF DRIVING PLASMA DISPLAY PANEL

(75) Inventors: Sung Hee Park, Daegu (KR); Ki Sang Hong, Pohang-shi (KR); Joong Seo Park, Daegu (KR)

(73) Assignee: LG Electronics Inc., Seoul (KR)

( * ) Notice: Subject to any disclaimer, the term of this patent is extended or adjusted under 35 U.S.C. 154(b) by 304 days.

(21) Appl. No.: 10/442,277

(22) Filed: May 21, 2003

(65) Prior Publication Data

US 2003/0218582 A1 Nov. 27, 2003

(30) Foreign Application Priority Data

May 22, 2002 (KR) ..... 10-2002-0028391
May 22, 2002 (KR) ..... 10-2002-0028392

(51) Int. Cl.
*G09G 3/28* (2006.01)

(52) U.S. Cl. ..... 345/60; 315/169.4

(58) Field of Classification Search ..... 345/37, 345/41, 60, 61, 64, 66
See application file for complete search history.

(56) References Cited

U.S. PATENT DOCUMENTS 5,841,413 A * 11/1998 Zhu et al. ..... 345/63
6,025,818 A * 2/2000 Okano ..... 345/63
6,160,349 A * 12/2000 Nagai ..... 315/85
6,476,781 B1 * 11/2002 Suzuki et al. ..... 345/60
6,496,165 B1 * 12/2002 Ide et al. ..... 345/60
6,525,486 B1 * 2/2003 Awamoto et al. ..... 315/169.4
6,774,874 B1 * 8/2004 Naka et al. ..... 345/60
6,879,305 B1 * 4/2005 Takeuchi et al. ..... 345/63
2002/0018033 A1 * 2/2002 Tanaka et al. ..... 345/60

FOREIGN PATENT DOCUMENTS

JP 2001340683 * 6/2001 ..... 345/60
KR 2000-0070948 11/2000

* cited by examiner

*Primary Examiner*—Richard Hjerpe
*Assistant Examiner*—Jean Lesperance
(74) *Attorney, Agent, or Firm*—Fleshner & Kim, LLP

(57) ABSTRACT

There is disclosed a method and apparatus of driving a plasma display panel that is adaptive for expressing linear gray levels by way of preventing a gray level inversion.

A driving method of a plasma display panel according to an embodiment of the present invention includes allocating a first brightness weight to the sub-fields; and setting a second brightness weight by way of subtracting the amount of light generated during the address period from the first brightness weight.

9 Claims, 6 Drawing Sheets

METHOD AND APPARATUS OF DRIVING PLASMA DISPLAY PANEL

This application claims the benefit of the Korean Patent Application No. P02-028391 and P02-028392 filed on May 22, 2002, which is hereby incorporated by reference.

BACKGROUND OF THE INVENTION

1. Field of the Invention

The present invention relates to a method and apparatus of driving a plasma display panel, and more particularly to a method and apparatus of driving a plasma display panel that is adaptive for expressing linear gray levels by way of preventing a gray level inversion.

2. Description of the Related Art

A plasma display panel PDP is a display device using a phenomenon that visible ray is generated from a fluorescent substance when vacuum ultraviolet ray generated by gas discharge excites the fluorescent substance. The PDP is thinner and lighter than a cathode ray tube CRT, which has been used as main display means so far, and can be embodied of high definition and wide screen. The PDP includes a plurality of discharge cells arranged in a matrix, and one discharge cell constitutes one pixel of a screen.

FIG. 1 is a perspective view illustrating a discharge cell structure of a three-electrode AC surface discharge PDP of the related art.

Referring to FIG. 1, the discharge cell of the three-electrode AC surface discharge PDP of the related art includes a first electrode 12Y and a second electrode 12Z formed on an upper substrate 10, and an address electrode 20X formed on a lower substrate 18.

An upper dielectric layer 14 and a passivation film 16 are deposited on the upper substrate 10 provided with the first and second electrodes 12Y and 12Z. Wall charges generated upon plasma discharge are accumulated in the upper dielectric layer 14. The passivation film 16 prevents the damage of the upper dielectric layer 14 caused by the sputtering generated upon the plasma discharge and, at the same timer increases the emission efficiency of secondary electrons. The passivation film 16 is usually magnesium oxide MgO.

A lower dielectric layer 22 and barrier ribs 24 on the lower substrate 18 provided with the address electrode 20X, and a phosphorus layer 26 is spread on the surface of the lower dielectric layer 22 and the barrier ribs 24. The address electrode 20X is formed crossing the first and second electrode 12Y and 12Z.

The barrier ribs 24 are formed parallel to the address electrode 20X to prevent an ultraviolet ray and a visible ray from leaking out to adjacent discharge cells, wherein the ultraviolet ray and the visible ray are generated by discharge. The phosphorus layer 26 is excited by the ultraviolet ray generated upon the plasma discharge to generate any one of red, green or blue visible ray. An inert mixed gas for gas discharge is injected into a discharge space provided between the upper substrate 10, the lower substrate 18 and the barrier ribs 24.

The PDP is driven by way of dividing one frame into several sub-fields that have a different number of discharges, for realizing the gray level of a picture. Each sub-field can be divided again into a reset period to generate a uniform discharge, an address period to select discharge cells and a sustain period to realize gray levels in accordance with the number of discharges.

For instance, in the event that it is wanted to display a picture with 256 gray levels, a frame period, 16.67 ms, corresponding to 1/60 second is divided into 8 sub-fields, as in FIG. 2. In addition, each of 8 sub-fields SF1 To SF8 is divided again into the reset period, the address period and the sustain period, Herein, the reset period and the address period of each sub-field are the same for each sub-field, whereas the sustain period increases at the rate of 2n (n=0,1,2,3,4,5,6,7) in each sub-field.

FIG. 3 is a waveform diagram representing a driving method of a three-electrode AC surface discharge PDP of the related art.

Referring to FIG. 3, one sub-field is divided into a reset period to initialize the whole screen, an address period to write data while scanning the whole screen in the line sequential color TV system, and a sustain period to keep the light emission state of cells to which the data are written.

Firstly, in the reset period, reset waveforms RP are applied to first electrode lines Y1 to Ym. If the reset waveforms are applied to the first electrode lines Y1 to Ym, reset discharges are generated between the first electrode lines Y1 to Ym and second electrode lines Z1 to Zm to initialize discharge cells.

In the address period, scan pulses SP are sequentially applied to the first electrode lines Y1 to Ym. Address electrode lines X1 to Xn are supplied with data pulses Dp synchronized with the scan pulses SP. At this moment, address discharges are generated in the discharge cells to which the data pulses Dp and the scan pulses SP.

In the sustain period, first and second sustain pulses SUSPy and SUSPz are supplied to the first electrode lines Y1 to Ym and the second electrode lines Z1 to Zm. At this moment, sustain discharges are generated at the discharge cells where the address discharges are generated.

The brightness of such a PDP is determined as in Formula 1.

$$B_{graylevel} = \text{gain} \times \sum_{i=1}^{k} A_i \times N_i \times s \qquad \text{[FORMULA 1]}$$

Herein, 'B' represents brightness, 'A' represents sub-field map information, 'k' represents the number of sub-fields, 'N' represents sub-field weight, and 's' represents one time discharge brightness of sustain pulse.

Gain can be obtained using the ratio of the number of sustains to the number of gray levels. In other words, gain=the total number of sustains/(gray level−1). For instance, if the total number of sustains is 255 and the gray level is 256, the gain can be set to be '1'.

The sub-field mapping information A represents selection information during the address period. For example, if a discharge cell is selected during the address period, the sub-field mapping information (A) is set to be '1', and if a discharge cell is not selected during the address period, the sub-field mapping information A is set to be '0'. The sub-field weight (N) corresponds to the number of current sub-fields (k). 's' represents the brightness generated by one time sustain discharge.

For example, in the plasma display panel, if the gain is to be '1', twelve sub-fields are included and the sub-fields weights are set to be '1, 2, 4, 8, 16, 32, 32, 32, 32, 32, 32, 32', the brightness of the PDP can be set as in Table 1.

TABLE 1

| Gray level | Sub-field weight 1 | 2 | 4 | 8 | 16 | 32 | 32 | 32 | 32 | 32 | 32 | 32 | Brightness |
|---|---|---|---|---|---|---|---|---|---|---|---|---|---|
| 0 | X | X | X | X | X | X | X | X | X | X | X | X | 0 S |
| 1 | 0 | X | X | X | X | X | X | X | X | X | X | X | 1 S |
| 2 | X | 0 | X | X | X | X | X | X | X | X | X | X | 2 S |
| . . . | | | | | | . . . | | | | | | | . . . |
| 31 | 0 | 0 | 0 | 0 | 0 | X | X | X | X | X | X | X | 31 S |
| 32 | X | X | X | X | X | 0 | X | X | X | X | X | X | 32 S |
| . . . | | | | | | . . . | | | | | | | . . . |
| 255 | 0 | 0 | 0 | 0 | 0 | 0 | 0 | 0 | 0 | 0 | 0 | 0 | 255 S |

Herein, 'X' represents that gray level is not expressed, and '0' represents that gray level is expressed. As can be seen in Table 1, the PDP includes twelve sub-fields, and gray levels of 256 is expressed in use of the brightness weight of '1, 2, 4, 8, 16, 32, 32, 32, 32, 32, 32, 32'.

Table 1 represents the brightness of the PDP in consideration of only the light generated by sustain discharge. However, the PDP, when actually driven, generates light not only by a sustain discharge but by a reset discharge and an address discharge. In this way, if gray level is expressed including the reset discharge, the address discharge and the sustain discharge, there occurs a gray level inversion as in FIG. 4. In other words, it happens that the brightness of the PDP expressed in the gray level of n−1 is brighter than the brightness of the PDP expressed in the gray level of n (n is a natural number).

To describe this more specifically, sub-fields with the brightness weights of 1, 2, 4, 8, 16 are to selected to express the gray level of 31, as shown in Table 1. Accordingly, the address discharges are generated in five sub-fields in order to express the gray level of 31. As compared with this, one sub-field with the brightness weight of 32 is to be selected in order to express the gray level of 32. Accordingly, the address discharge is generated in one sub-field in order to express the gray level of 32. At this moment, the light generated by the address discharge is caused to generate a brightness inversion between the gray levels of 31 and 32. In other words, the gray level of 31 generates brighter light than the gray level of 32.

The brightness of the PDP including the light generated in the actual reset discharge and address discharge is determined as in Formula 2.

$$B_{graylevel}(r, a, s) = L \times r + \sum_{i=1}^{k} A_i \times a + \text{gain} \times \sum_{i=1}^{k} A_i \times N_i \times s \quad \text{[FORMULA 2]}$$

Herein, 'L' represents the number of sub-fields that are reset at the beginning, 'r' is one time discharge brightness of reset pulse, and 'a' is one time discharge brightness of address pulse.

'L' represents the number of sub-fields where the reset discharges are generated. For example, if the PDP includes twelve sub-fields and the reset discharges are generated in twelve sub-fields, 'L' is set to be '12'.

A matrix as in Formula 3 can be derived from Formula 2.

$$\begin{pmatrix} 12 & 0 & 0 \\ 12 & 1 & 1 \\ \dots & \dots & \dots \\ 12 & 12 & 255 \end{pmatrix} \begin{pmatrix} r \\ a \\ s \end{pmatrix} = \begin{pmatrix} 0.9487 \\ 2.275625 \\ \dots \\ 124.85 \end{pmatrix} \quad \text{[FORMULA 3]}$$

On the other hand, in the related art PDP, a sustain pulse pair is additionally supplied for each sub-field in order to stabilize the sustain discharge during the sustain period. The brightness of the PDP including the light generated from the sustain pulse pair is determined as in Formula 4.

$$B_{graylevel}(r, a, s) = L \times r + \sum_{i=1}^{k} Ai \times a + \text{gain} \times \sum_{i=1}^{k} Ai \times N_i \times s + \sum_{i=1}^{k} Ai \times s \quad \text{[FORMULA 4]}$$

In this way, the matrix as in Formula 3 is derived from Formula 4, the values of 'r', 'a' and 's' can be obtained in use of this. In fact, the value of 'r' (one time discharge brightness of the reset pulse) is 0.208815[cd/m$^2$], the value of 'a' (one time discharge brightness of the address pulse) is 0.413396[cd/m$^2$], and the value of 's' (one time discharge brightness of the sustain pulse) is 0.44553[cd/m$^2$]. Herein, the values of 'r', 'a' and 's' are not actual brightness but calculated values from formulas. If the values of 'r', 'a' and 's' are substituted into each formula, it is possible to obtain a brightness similar to the actual brightness.

In this way, the brightness of the PDP including the discharge brightness of the reset pulse, the discharge brightness of the address pulse and the discharge brightness of the sustain pulses, i.e., the brightness of the PDP by Formula 4, can be shown as in Table 2.

TABLE 2

| Gray level | Sub-field weight 1 | 2 | 4 | 8 | 16 | 32 | 32 | 32 | 32 | 32 | 32 | 32 | Brightness |
|---|---|---|---|---|---|---|---|---|---|---|---|---|---|
| 0 | X | X | X | X | X | X | X | X | X | X | X | X | 12 r + 0 a + 0 s + 0 s |
| 1 | 0 | X | X | X | X | X | X | X | X | X | X | X | 12 r + 1 a + 1 s + 1 s |
| 2 | X | 0 | X | X | X | X | X | X | X | X | X | X | 12 r + 1 a + 2 s + 1 s |
| . . . | | | | | | . . . | | | | | | | . . . |
| 31 | 0 | 0 | 0 | 0 | 0 | X | X | X | X | X | X | X | 12 r + 5 a + 31 s + 5 s |
| 32 | X | X | X | X | X | 0 | X | X | X | X | X | X | 12 r + 1 a + 32 s + 1 s |
| . . . | | | | | | . . . | | | | | | | . . . |
| 255 | 0 | 0 | 0 | 0 | 0 | 0 | 0 | 0 | 0 | 0 | 0 | 0 | 12 r + 12 a + 255 s + 12 s |

In Table 2, only the brightness of reset pulse generated at twelve sub-fields in the gray level of '0'. In the gray level of '1', there are shown the sustain brightness corresponding to the brightness weight of '1', the brightness by one sustain pulse pair, the brightness by twelve reset pulses, and the brightness by one address discharge. Further, in the gray level of '31', there are shown the sustain brightness corresponding to the brightness weight of '31', the brightness by five sustain pulse pairs, the brightness by twelve reset pulses, and the brightness by five address discharges. And, in the gray level of '32', there are shown the sustain brightness corresponding to the brightness weight of '32', the brightness by one sustain pulse pair, the brightness by twelve reset pulses, and the brightness by one address discharge.

Herein, if the values of 'r', 'a' and 's' are substituted in the gray level of '31', the brightness of '20,61184' is expressed in the PDP. Further, if the values of 'r', 'a' and 's' are substituted in the gray level of '32', the brightness of '17.62166' is expressed in the PDP. That is, there occurs the gray level inversion in the related art PDP. Accordingly, it is not possible to display a picture with a linear brightness.

On the other hand, the gray level inversion is generated not only in the driving method of the sub-field, but also in a driving apparatus as in FIG. 5.

FIG. 5 is a diagram representing a driving apparatus of a plasma display panel of the related art.

Referring to FIG. 5, the driving apparatus of the related art PDP includes a first reverse gamma corrector 32A, a gain controller 34, a error diffuser 36, a sub-mapping unit 38 and a data aligner 40 connected between an input line 1 and a panel 46: and a second reverse gamma corrector 32B, an average picture level APL part 42, and a waveform generator 44 connected between the input line 1 and the panel 46.

The first and second reverse gamma correctors 32A and 32B perform reverse gamma correction on a gamma corrected video signal to linearly convert the brightness value in accordance with the gray level value of the video signal.

The APL part 42 receives the video data corrected by the second reverse gamma corrector 32B to generate Y (Y is a natural number) step signal for controlling the number of sustain pulses. The gain controller 34 amplifies the corrected video data from the first reverse gamma corrector 32A by as much as effective gain.

The error diffuser 36 diffuses an error component of a cell to adjacent cells to finely control the brightness value. The sub-field mapping unit 38 re-allots the video data corrected from the error diffuser 36 by sub-fields.

The data aligner 40 converts the video data inputted from the sub-field mapping unit 38 to be suitable for the resolution format of the panel 46, and then supplies to an address driving integrated circuit (hereinafter, referred to as IC) of the panel 46.

The waveform generator 44 generates a timing control signal by the inputted Y step signal from the APL part 42 and supplies the generated timing control signal to an address drive IC, a scan drive IC and a sustain drive IC of the panel 46.

In the driving apparatus of the related art PDP, the APL part 42 receives the video data and calculates the APL step in accordance with the inputted video data. At this moment, the number of sustain pulses is determined to correspond to the APL step. In the APL part 42, the number of sustain pulses, as shown in FIG. 6, is set to have an inverse proportional relationship with the APL step. That is, the number of sustain pulses decreases as the APL step increases, and the number of sustain pulses increases as the APL step decreases. In this way, if the APL step and the number of sustain pulses have the inverse relationship, power consumption can be sustained uniformly.

On the other hand, the APL part 42 determines the number of sustain pulses by way of rounding to the nearest whole number when the number of sustain pulse corresponding to the APL step has a fractional value. For example, if the number of sustain pulses corresponding to a hundredth step of APL is 500.5762 in FIG. 6, the APL part 42 rounds the number of sustain pulses to the nearest whole number to set the number of sustain pulses as 501.

However, if the number of sustain pulses is rounded to be set in the APL part 42, the gray level inversion become more serious.

SUMMARY OF THE INVENTION

Accordingly, it is an object of the present invention to provide a method and apparatus of driving a plasma display panel that is adaptive for expressing linear gray levels by way of preventing a gray level inversion.

In order to achieve these and other objects of the invention, a driving method of a plasma display panel according to an aspect of the present invention includes allocating a first brightness weight to the sub-fields; and setting a second brightness weight by way of subtracting the amount of light generated during the address period from the first brightness weight.

Gray levels are expressed by the second brightness weight in the plasma display panel.

The first brightness weight determines the sub-field driven in correspondence to data supplied from the outside.

A sustain pulse pair is additionally supplied for each sub-field so as to stabilize a sustain discharge generated during the sustain period.

The second brightness weight is set by way of additionally subtracting a light generated by the sustain pulse pair.

A driving method of a plasma display panel according to another aspect of the present invention includes allocating a first brightness weight to a plurality sub-fields; and setting an actually-expressed second brightness weight by way of subtracting a light generated during an address period and a light generated from a sustain pulse pair additionally supplied during a sustain period, from the first brightness weight.

A driving method of a plasma display panel according to still another aspect of the present invention includes generating an average picture level that has an inverse relationship with the number of sustain pulses for power dissipation to be sustain uniformly in use of video data supplied from the outside; and setting the number of sustain pulses corresponding to the average picture level by way of rounding down.

A driving apparatus of a plasma display panel according to still another aspect of the present invention includes a reverse gamma corrector for performing reverse gamma correction on gamma-corrected video data supplied from the outside; and an average picture level part receiving the reverse gamma-corrected video data to generate a Y (Y is a natural number) step signal for controlling the number of sustain pulses and, in addition, determining the number of sustain pulses corresponding to the Y step signal by way of rounding down.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
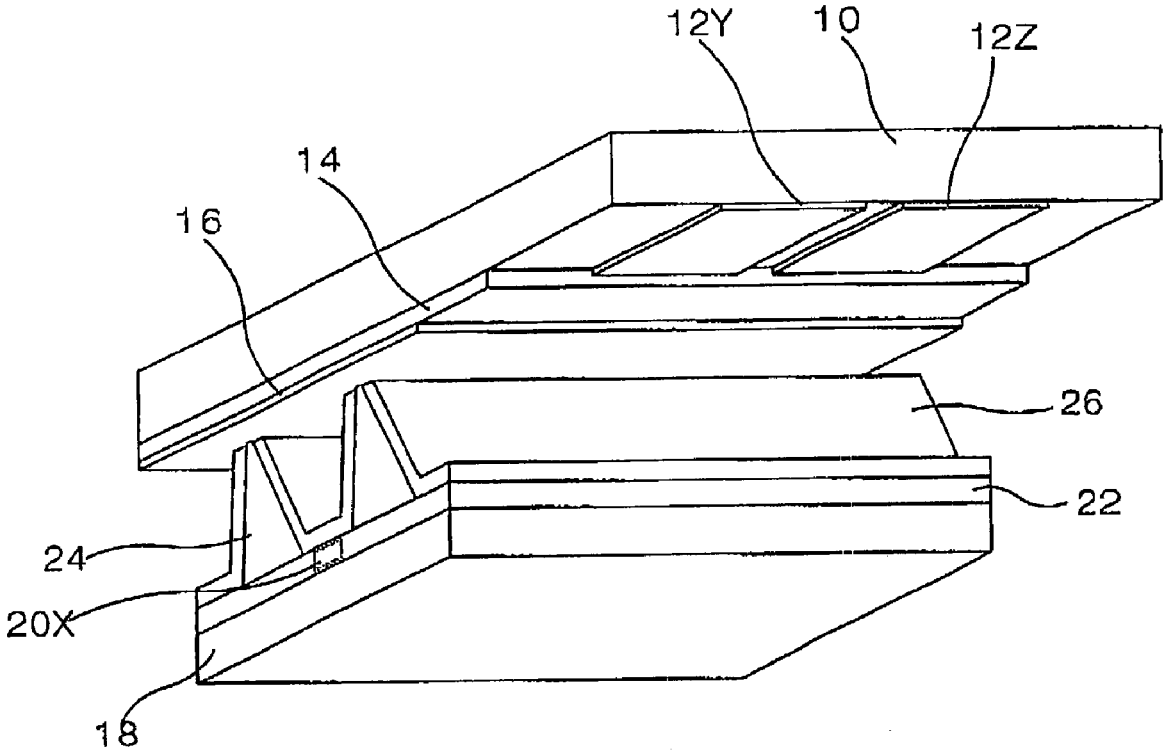
FIG. 1 RELATED ART
FIG. 1 is a perspective view representing a discharge cell structure of a three electrode AC surface discharge plasma display panel of the related art.
Figure 2:
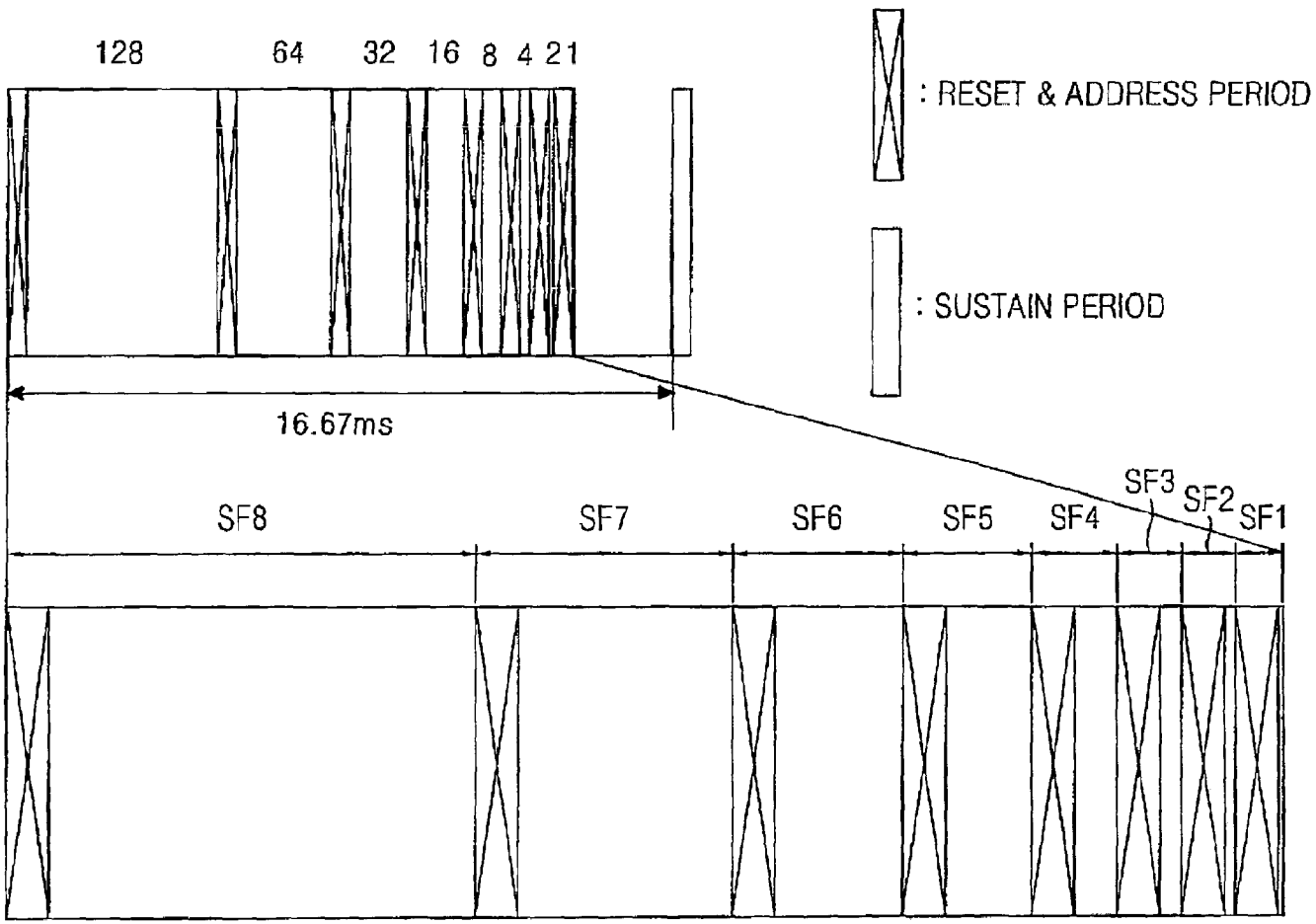
FIG.2 RELATED ART
FIG. 2 is a diagram representing a plurality of sub-fields included in one frame of a plasma display panel of the related art.
Figure 3:
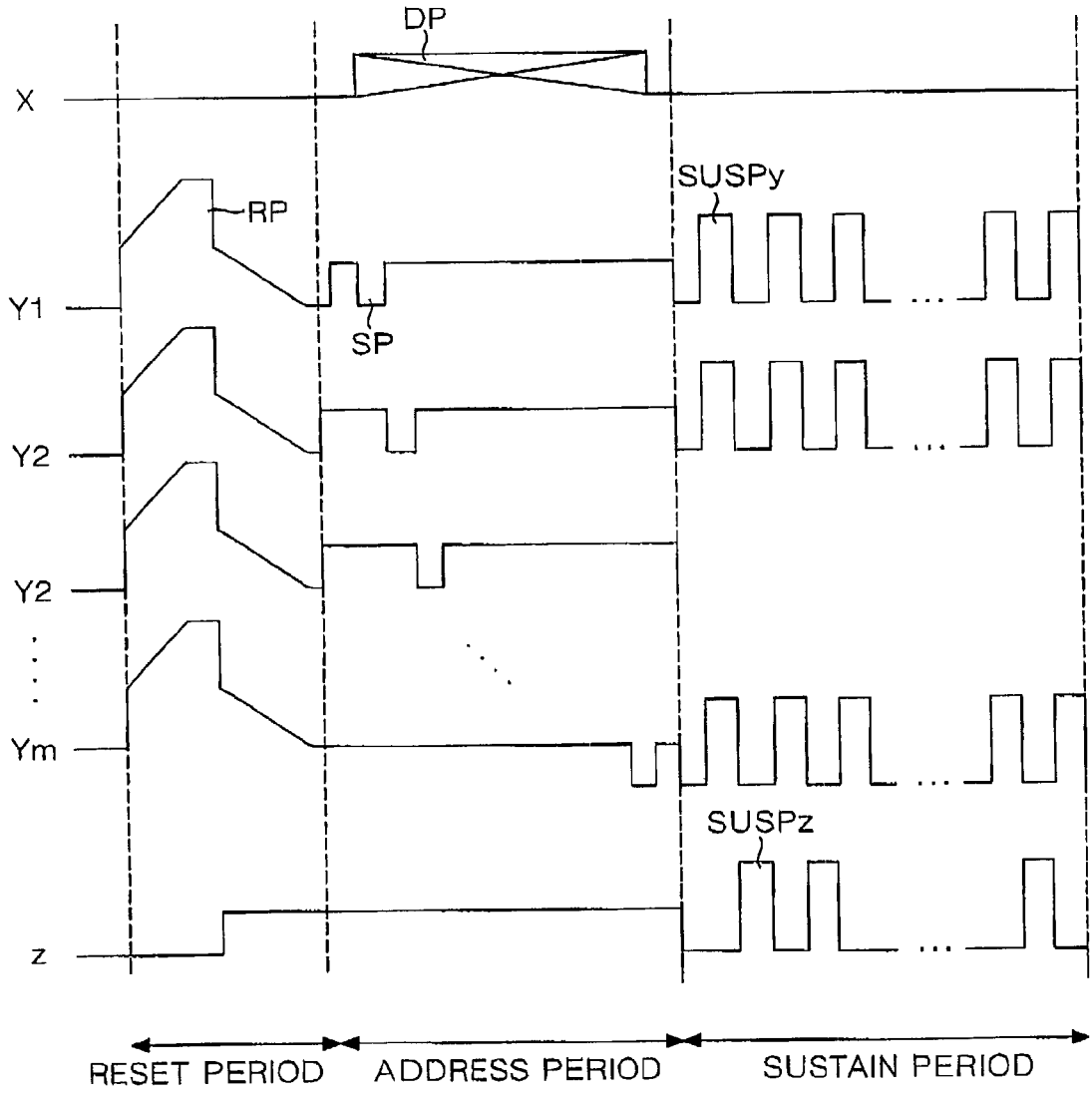
FIG.3 RELATED ART
FIG. 3 is a waveform diagram representing a drive waveform applied to a plasma display panel of the related art.
Figure 4:
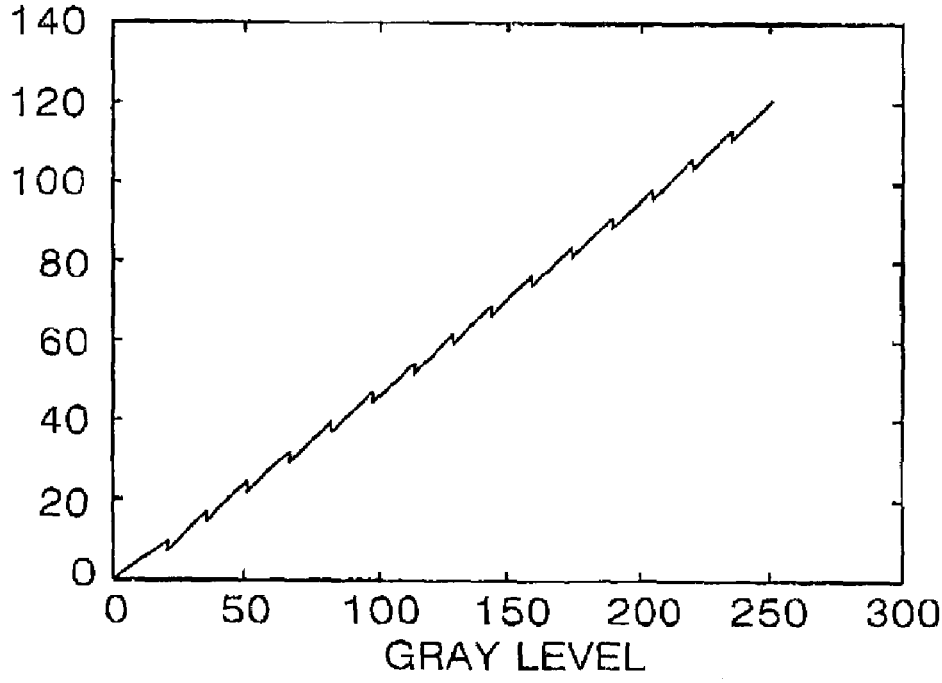
FIG. 4 RELATED ART
FIG. 4 is a graph representing brightness in accordance with gray levels displayed at a plasma display panel of the related art.
Figure 7:
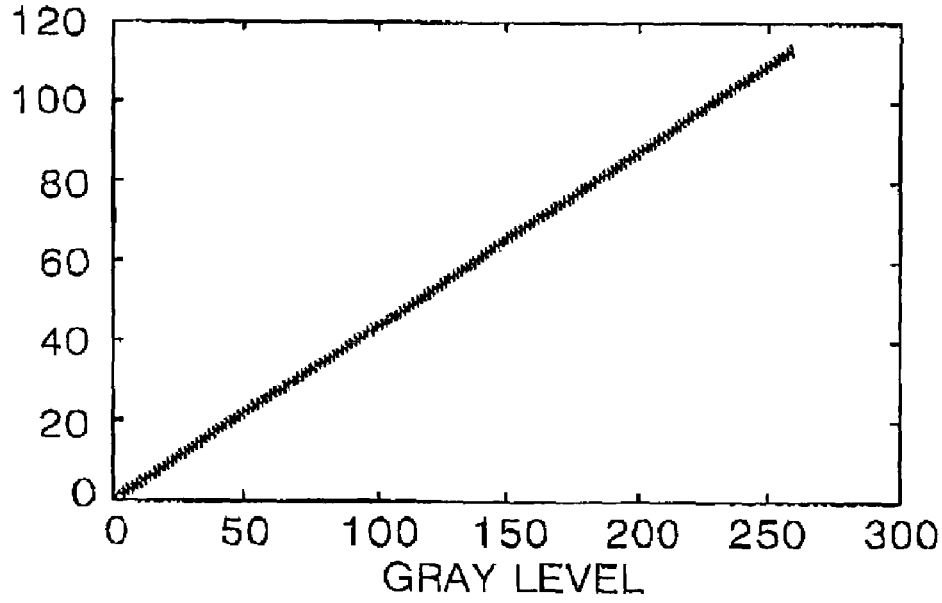
FIG. 7 is a graph representing brightness in accordance with gray levels displayed at a plasma display panel according to an embodiment of the present invention.

With reference to FIG. 7, embodiments of the present invention will be explained as follows.

Table 3 represents gray levels of a plasma display panel according to an embodiment of the present invention.

On the other hand, as described in Formula 4, the one time discharge brightness of the address pulse (a) and the one time discharge brightness of the sustain pulse (b) have almost the same value. Further, one time discharge brightness of the reset pulse generates a light with a brightness lower than one time discharge brightness of the address pulse and one time discharge brightness of the sustain pulse. In fact, the reset pulse is included in all sub-fields regardless of presence or absence of the address discharge. Accordingly, it is possible to prevent the brightness inversion if one time discharge brightness of the sustain pulse and the address discharge brightness except for the brightness by the reset pulse is subtracted from all sub-fields.

Accordingly, in an embodiment of the present invention, a sub-field weight value of '2' is subtracted from the first brightness weights, '1, 2, 4, 8, 16, 32, 32, 32, 32, 32, 32, 32', in consideration of the address discharge brightness and one time brightness of the sustain pulse, so as to set an actually expressed brightness weight as in Table 3. That is, the PDP of the present invention has the brightness weights of '0, 0, 2, 6, 14, 30, 30, 30, 30, 30, 30, 30' as in Table 3.

On the other hand, as shown in Table 3, in order to express the gray level of '31', first to fifth sub-fields are driven in case that the gain is '1'. At this moment, the gray level of '22' is actually expressed in the PDP. That is, in this invention, a sub-field to be driven is determined in use of the first brightness weight, then the light generated by the address discharge and one time sustain pulse discharge is subtracted from the first brightness weight to express gray level.

In fact, a linear gray level, as in FIG. 7, is expressed without any gray level inversion in the PDP driven like Table 3. More specifically, if the values of 'r', 'a' and 's' are substituted in the gray level of '31', the brightness of '16.60207' is expressed in the PDP. Further, if the values of 'r', 'a' and 's' are substituted in the gray level of '32', the brightness of '16.730606' is expressed in the PDP. That is, in the PDP of the present invention, since the gray level is expressed by way of subtracting the light generated by the address discharge and one time discharge of the sustain pulse, no gray level inversion occurs. Accordingly, it is possible to display a picture with a linear brightness.

Figure 5:
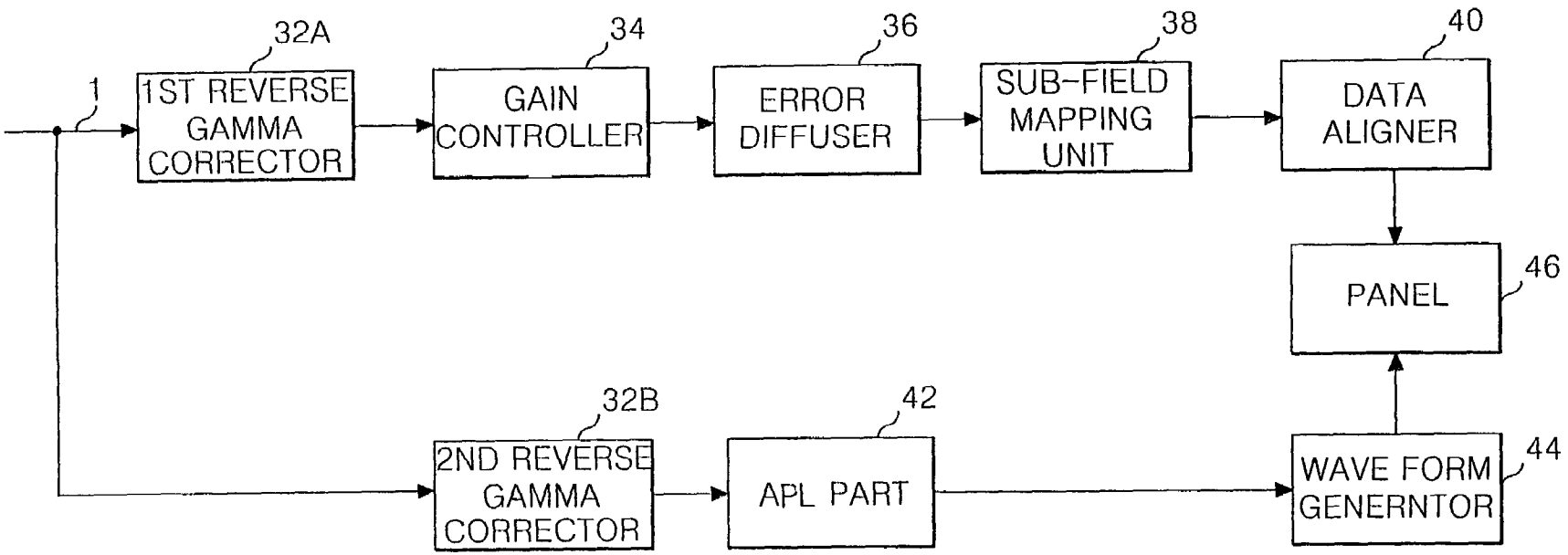
FIG.5 RELATED ART
FIG. 5 is a diagram representing a driving apparatus of a plasma display panel of the related art.
Figure 6:
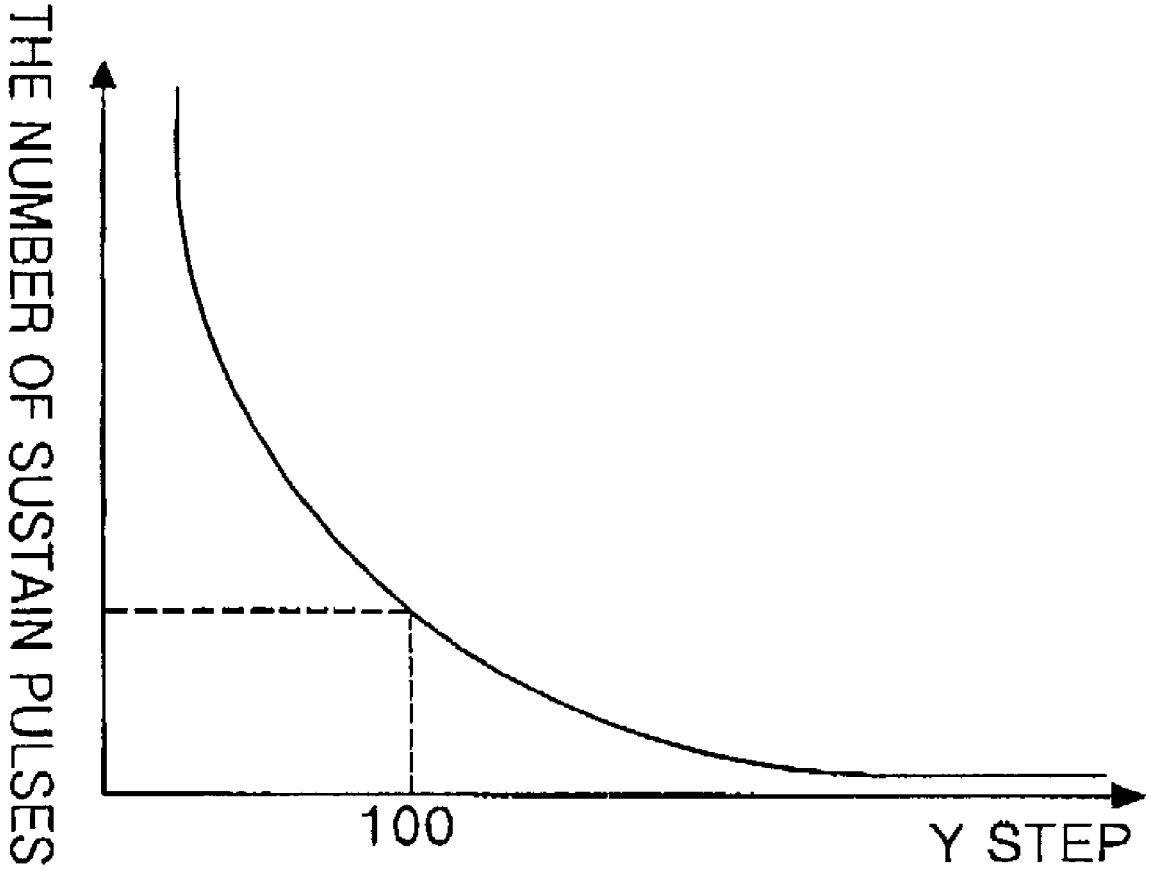
FIG. 6 RELATED ART
FIG. 6 is a graph representing the number of sustain pulses set in correspondence to the related art APL part step.

On the other hand, in the present invention, the APL part 42 shown in FIG. 5 determines the number of sustain pulses in use of a method of rounding down when the number of sustain pulse has a fractional value. For example, if the number of sustain pulses corresponding to a hundredth step of APL is 500.5762 in FIG. 6, the APL part 42 rounds down the number of sustain pulses to set the number of sustain pulses as 501.

TABLE 3

| Gray | Sub-field weight | | | | | | | | | | | | |
|---|---|---|---|---|---|---|---|---|---|---|---|---|---|
| level | 1 | 2 | 4 | 8 | 16 | 32 | 32 | 32 | 32 | 32 | 32 | 32 | Brightness |
| 0 | X | X | X | X | X | X | X | X | X | X | X | X | 12 r + 0 a + 0 s + 0 s |
| 1 | 0 | X | X | X | X | X | X | X | X | X | X | X | 12 r + 1 a + 0 s + 1 s |
| 2 | X | 0 | X | X | X | X | X | X | X | X | X | X | 12 r + 1 a + 0 s + 1 s |
| . . . | | | | | | . . . | | | | | | | . . . |
| 31 | 0 | 0 | 0 | 0 | 0 | X | X | X | X | X | X | X | 12 r + 5 a + 22 s + 5 s |
| 32 | X | X | X | X | X | 0 | X | X | X | X | X | X | 12 r + 1 a + 30 s + 1 s |
| . . . | | | | | | . . . | | | | | | | . . . |
| 255 | 0 | 0 | 0 | 0 | 0 | 0 | 0 | 0 | 0 | 0 | 0 | 0 | 12 r + 12 a + 232 s + 12 s |

Herein, 'X' represents that gray level is not expressed, and '0' represents that gray level is expressed. Further, gain is set to be '1' in the Table 3.

As can be seen in Table 3, the PDP includes twelve sub-fields, and first brightness weights of the PDP are set to be '1, 4, 8, 16, 32, 32, 32, 32, 32, 32, 32' in the same way as Table 2 of the related art. Herein, the gray levels actually expressed in the PDP of the present invention are expressed by way of subtracting the light generated at a sustain pulse pair from the first brightness weight of the PDP, wherein the sustain pulse pair is added for preventing an unwanted discharge from being generated during a sustain period and/or an address discharge. Accordingly, the light generated by one time discharge of a sustain pulse, a reset discharge and an address discharge needs to be subtracted from each sub-field in order to prevent a brightness inversion.

In this way, if the number of sustain pulses is set by way of rounding down at the APL part 42, the brightness inversion can be minimized. In other words, if the number of sustain pulses is set by rounding down at the APL part 42, the sub-field includes a fewer number of sustain pulses by 0–1 than the related art method of rounding to the nearest whole number. If the sub-field includes the fewer number of sustain pulses that the related art, the amount of light by the address discharge is reduced by some extent to reduce the brightness inversion.

As described above, according to the driving method and apparatus of the plasma display panel of the present invention, the gray level inversion can be prevented by way of subtracting the brightness by the address discharge and the brightness by the discharge of additionally-inserted one sustain pulse pair in all sub-fields to set the gray level. Accordingly, it is possible to display the picture with the linear brightness in the plasma display panel of the present invention. In addition, the brightness inversion can be prevented by way of setting the number of sustain pulses corresponding to the APL step in the method of rounding down.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving method of a plasma display panel where one frame is divided into a plurality of sub-fields and each sub-field includes an address period and a sustain period, comprising:

allocating first brightness weights to the sub-fields; and setting second brightness weights to the sub-fields by subtracting a value from the first brightness weights, the subtracted value being based on an amount of light generated during the address period.

2. The driving method according to claim 1, further comprising expressing gray levels by the second brightness weights in the plasma display panel.

3. The driving method according to claim 1, wherein the first brightness weights determine the sub-field driven in correspondence to data supplied from the outside.

4. The driving method according to claim 1, wherein a sustain pulse pair is additionally supplied for each sub-field so as to stabilize a sustain discharge generated during the sustain period.

5. The driving method according to claim 4, wherein setting the second brightness weights additionally includes subtracting a value corresponding to light generated by the sustain pulse pair from the first brightness weight.

6. A driving method of a plasma display panel, comprising:

allocating first brightness weights to a plurality sub-fields; and setting second brightness weights to each of the plurality of sub-fields by subtracting a particular value from the first brightness weights, the particular value being based on a light generated during an address period and a light generated from a sustain pulse pair supplied during a sustain period.

7. A driving method of a plasma display panel, comprising:

generating an average picture level that has an inverse relationship with a number of sustain pulses for power dissipation to be sustained uniformly when using video data; and setting the number of sustain pulses corresponding to the average picture level by always rounding down to a whole number when the number of sustain pulses has a fractional value.

8. A driving apparatus of a plasma display panel, comprising:

a reverse gamma corrector for performing reverse gamma correction on gamma-corrected video data; and an average picture level part receiving the reverse gamma-corrected video data to generate a Y (Y is a natural number) step signal for controlling a number of sustain pulses and the average picture level part determining the number of sustain pulses corresponding to the Y step signal by always rounding down the number of sustain pulses to a whole number when the number of sustain pulses has a fractional value.

9. A plasma display driving method comprising:

allocating a first brightness weight to at least one sub-field of a frame; and setting a second brightness weight to the at least one sub-field by subtracting a value from the first brightness weight, the subtracted value based at least on light generated during an address period.

* * * * *